US012185792B2

(12) United States Patent
Suzuki et al.

(10) Patent No.: US 12,185,792 B2
(45) Date of Patent: Jan. 7, 2025

(54) UPPER AND SHOE

(71) Applicant: ASICS CORPORATION, Kobe (JP)

(72) Inventors: Chihaya Suzuki, Hyogo (JP); Seiji Yano, Hyogo (JP); Hiroki Nakamura, Hyogo (JP)

(73) Assignee: ASICS CORPORATION, Kobe (JP)

( * ) Notice: Subject to any disclaimer, the term of this patent is extended or adjusted under 35 U.S.C. 154(b) by 202 days.

(21) Appl. No.: 17/932,717

(22) Filed: Sep. 16, 2022

(65) Prior Publication Data

US 2023/0098661 A1 Mar. 30, 2023

(30) Foreign Application Priority Data

Sep. 30, 2021 (JP) ..... 2021-160296

(51) Int. Cl.
*A43B 23/02* (2006.01)

(52) U.S. Cl.
CPC ..... *A43B 23/028* (2013.01)

(58) Field of Classification Search
CPC ..... A43B 23/0295; A43B 23/0235; A43B 23/0245
See application file for complete search history.

(56) References Cited

U.S. PATENT DOCUMENTS 10,980,316 B2 4/2021 Nonogawa et al.
2009/0241374 A1* 10/2009 Sato ..... A43B 1/04 66/170
2010/0269369 A1* 10/2010 Nishiwaki ..... A43B 23/047 36/28
2011/0041362 A1* 2/2011 Nishiwaki ..... A43B 23/047 36/114
2014/0352173 A1 12/2014 Bell et al.
2014/0352179 A1 12/2014 Bell et al.
2015/0272261 A1* 10/2015 Bell ..... D04B 21/06 66/170
2016/0174661 A1* 6/2016 Nonogawa ..... A43B 23/0235 36/88
2019/0248089 A1* 8/2019 Busbee ..... A41C 5/00
2019/0313738 A1 10/2019 Dorjgurkhem et al.
2020/0008514 A1* 1/2020 Dua ..... B29D 35/146
2020/0288813 A1* 9/2020 Beye ..... A43B 1/0072
2021/0204653 A1 7/2021 Nonogawa et al.

FOREIGN PATENT DOCUMENTS

JP 6306590 B2 4/2018

OTHER PUBLICATIONS

The extended European search report issued by the European Patent Office on Jan. 30, 2023, which corresponds to European Patent Application No. 22196918.1-1015 and is related to U.S. Appl. No. 17/932,717.

* cited by examiner

*Primary Examiner* — Jillian K Pierorazio
(74) *Attorney, Agent, or Firm* — Studebaker & Brackett PC

(57) ABSTRACT

An upper includes an upper main body that covers an instep of a foot. The upper main body includes: a first portion including a plurality of linear bodies and formed by one layer; and a bag-shaped second portion formed by two layers in which some of the plurality of linear bodies constituting the first portion serve as one layer and the rest of the plurality of linear bodies serves as another layer. Inside the second portion, a cushioning material is put. The second portion protrudes toward a foot of a wearer with respect to the first portion.

10 Claims, 16 Drawing Sheets

UPPER AND SHOE

CROSS-REFERENCE TO RELATED APPLICATIONS

The present application claims priority to and incorporates by reference the entire contents of Japanese Patent Application No. 2021-160296 filed in Japan on Sep. 30, 2021.

BACKGROUND OF THE INVENTION

1. Field of the Invention

The present invention relates to an upper and a shoe including the upper.

2. Description of the Related Art

Conventionally, shoe including an upper is known. As disclosed in JP 6306590 B2, an upper is generally manufactured by assembling a planar material into a three-dimensional shape. In the upper manufactured in this manner, a gap is likely to be generated between the upper and the foot at a portion where a curvature of the foot is low. If there is a partial gap between the upper and the foot, a pressure is not uniformly applied to the entire foot when the shoe is worn, so that fit feeling to the foot is reduced. Therefore, a technique of filling a gap generated between the upper and the foot has been developed.

For example, JP 6306590 B2 discloses an upper in which a lining material is attached to form a bag-shaped portion in a portion of the upper where a gap is to be generated, and a soft sponge is put inside the bag-shaped portion to provide a convex portion protruding toward a foot of a wearer. The lining material is attached to the upper by glue, sewing, or the like. In the upper disclosed in JP 6306590 B2, a gap generated between the upper and the foot can be filled with the convex portion.

However, in the upper disclosed in JP 6306590 B2, since the lining material is attached to the upper by glue, sewing, or the like to form the bag-shaped portion, there is a problem that the number of manufacturing processes for the upper and an amount of waste materials increase, leading to an increase in environmental load.

SUMMARY OF THE INVENTION

An upper according to an aspect of the invention includes an upper main body configured to cover an instep of a foot. The upper main body includes: a first portion including a plurality of linear bodies and formed by one layer; and a second portion having a bag shape and formed by two layers in which some of the plurality of linear bodies constituting the first portion serve as one layer and a rest of the plurality of linear bodies serves as another layer, a cushioning material is put inside the second portion, and the second portion protrudes toward a foot of a wearer with respect to the first portion.

DETAILED DESCRIPTION OF THE PREFERRED EMBODIMENTS

Figure 1:
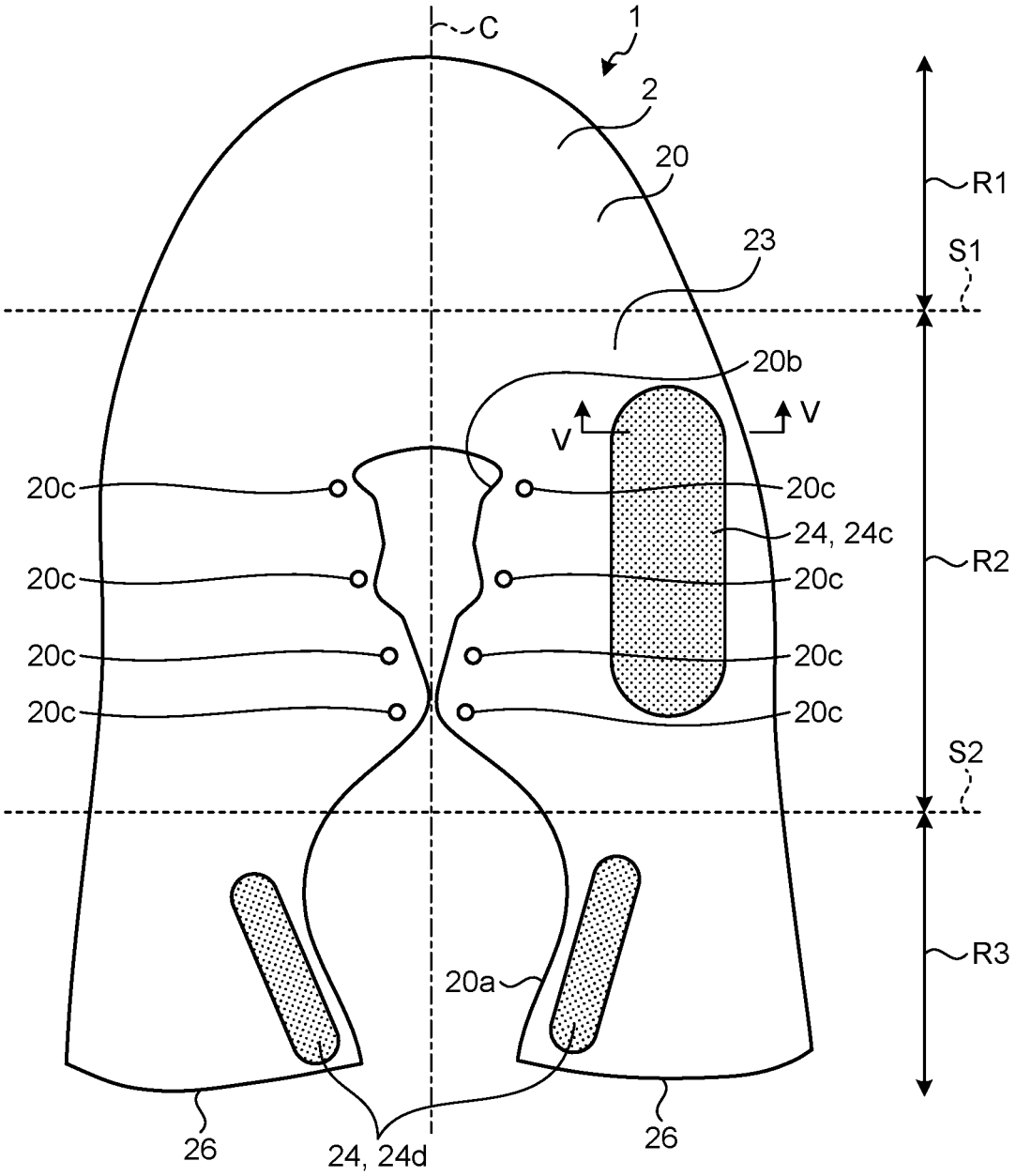
FIG. 1 is a developed view illustrating an upper main body of a shoe according to a first embodiment of the present invention.

Hereinafter, examples of an upper and a shoe according to the present invention will be described in detail with reference to the drawings. Note that the present invention is not limited by the examples. In the following description, identical portions are denoted by the same reference numerals, and redundant descriptions will be omitted.

First Embodiment

FIG. 1 is a developed view illustrating an upper main body 20 of a shoe 1 according to a first embodiment of the present invention. In the individual figures including FIG. 1, the shoe 1 for a left foot alone is illustrated. Since the shoe 1 has a laterally symmetrical structure for a left foot and a right foot, the shoe 1 for the left foot alone will be described in the present embodiment, and a description of the shoe 1 for the right foot will be omitted. Further, in the following description, an extending direction of a shoe center axis C, which is a perpendicular line passing through a center of the shoe 1 in plan view of the shoe 1, is referred to as a fore-rear direction, and a direction orthogonal to the fore-rear direction in plan view of the shoe 1 is referred to as a foot width direction.

Further, a direction from a heel toward a toe in a fore-rear direction in the shoe 1 is referred to as forward, and a direction from the toe toward the heel in the fore-rear direction in the shoe 1 is referred to as rearward.

In addition, a median side of a foot in the anatomical position is referred to as a medial foot side, and a side opposite to the median side of the foot in the anatomical position is referred to as a lateral foot side. That is, a side closer to the median line in the anatomical position is referred to as the medial foot side, and a side farther from the median line in the anatomical position is referred to as the lateral foot side.

In addition, an up-down direction means a direction orthogonal to both the fore-rear direction and the foot width direction unless otherwise specified.

An upper 2 includes: an upper forefoot portion R1 that covers a forefoot portion of a foot of a wearer of a standard body shape; an upper midfoot portion R2 that covers a midfoot portion of a foot of a wearer having a standard body shape; and an upper rearfoot portion R3 that covers a rearfoot portion of a foot of a wearer having a standard body shape. The upper forefoot portion R1, the upper midfoot portion R2, and the upper rearfoot portion R3 are connected in this order in the fore-rear direction from forward of the upper 2.

A line being along the foot width direction and passing a position corresponding to approximately 25% of a dimension from a front end of the upper 2 in the fore-rear direction of the upper 2 is defined as a first boundary line S1, and a line being along the foot width direction and passing a position corresponding to approximately 80% of a dimension from the front end of the upper 2 in the fore-rear direction of the upper 2 is defined as a second boundary line S2. The first boundary line S1 is a line substantially along an MP joint of a wearer having a standard body shape. The second boundary line S2 is a line substantially along the Chopart's joint of a wearer having a standard body shape. The upper forefoot portion R1 is a portion located forward of the first boundary line S1. The upper midfoot portion R2 is a portion located between the first boundary line S1 and the second boundary line S2. The upper rearfoot portion R3 is a portion located rearward of the second boundary line S2.

Figure 2:
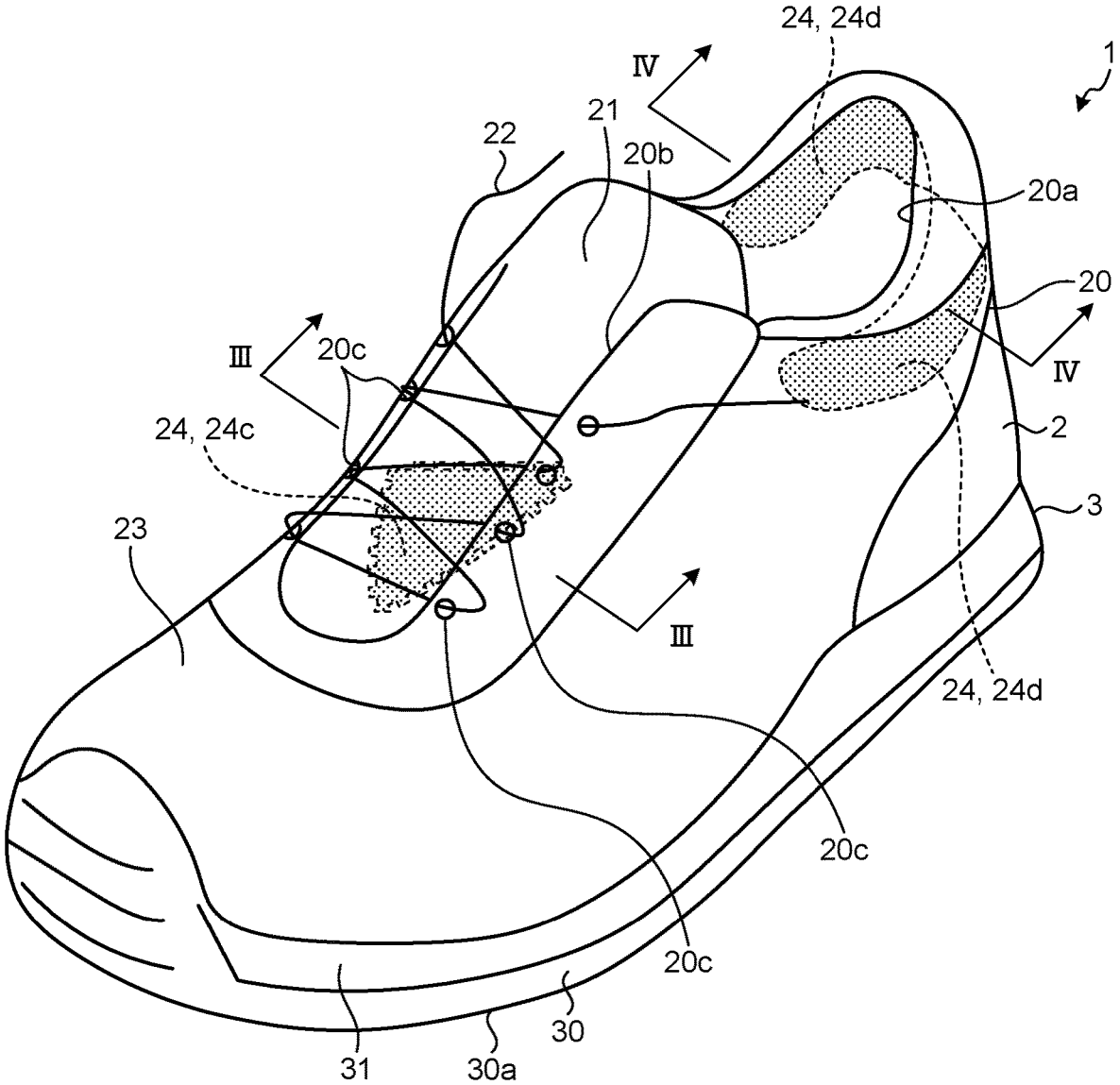
FIG. 2 is a perspective view illustrating the shoe according to the first embodiment.

FIG. 2 is a perspective view illustrating the shoe 1 according to the first embodiment. The shoe 1 is, for example, running shoe, other sports shoe, walking shoe, and climbing shoe. The shoe 1 includes the upper 2 and a sole 3.

The upper 2 is located above the sole 3. The upper 2 includes an upper main body 20, a shoe tongue 21, and a shoelace 22.

The upper main body 20 covers a portion on an instep side of a foot. In an upper portion of the upper main body 20, a foot insertion opening 20*a* for insertion of a foot of a wearer, and a throat portion 20*b* communicating with the foot insertion opening 20*a* and extending forward from the foot insertion opening 20*a* are formed. On side edges of the throat portion 20*b* on both sides in the foot width direction, string passing portions 20*c* spaced apart from each other in the fore-rear direction are provided. A configuration of the string passing portion 20*c* is not particularly limited as long as the shoelace 22 can pass through, but the string passing portion 20*c* is a through hole penetrating the upper main body 20 in the up-down direction, in the present embodiment. The upper main body 20 includes a first portion 23 and a plurality of second portions 24. Details of the first portion 23 and the second portion 24 will be described later. In the individual figures including FIG. 2, the second portion 24 is illustrated by dot hatching in order to distinguish between the first portion 23 and the second portion 24.

The shoe tongue 21 is a member for protection of an instep of a foot of a wearer. The shoe tongue 21 covers the throat portion 20*b* inside the upper main body 20. The shoe tongue 21 is fixed to the upper main body 20 by sewing, welding, bonding, or a combination thereof. As materials of the upper main body 20 and the shoe tongue 21, for example, a knitted fabric in which a yarn is made round into a chain shape and chain portions are hooked with each other to form a cloth shape, a woven fabric in which warp yarns and weft yarns are crossed with each other at a certain angle to form a cloth shape, a braid in which three or more braids are crossed with each other and run obliquely to form a cloth shape, or the like is used. In particular, in the shoe 1 required to have air permeability and lightweight property, the material of the upper main body 20 and the shoe tongue 21 may be a double raschel warp knitted fabric knitted with polyester yarn. Note that the material of the shoe tongue 21 is not limited to the exemplified material.

The shoelace 22 is a string-shaped member that is alternately passed through the string passing portion 20*c* provided at one side edge in the foot width direction of the throat portion 20*b* and the string passing portion 20*c* provided at another side edge in the foot width direction of the throat portion 20*b*. The shoelace 22 is detachably attached to the upper main body 20.

In the present embodiment, the upper 2 including the shoe tongue 21 and the shoelace 22 will be described as an example, but the upper 2 may have a monosock structure in which a portion corresponding to the shoe tongue 21 is integrated with an ankle portion of the upper main body 20. In addition, a hook-and-loop fastener may be used instead of the shoelace 22 to bring the upper main body 20 into close contact with the foot. When the hook-and-loop fastener is used to bring the upper main body 20 into close contact with the foot, the string passing portion 20*c* is not formed in the upper main body 20.

The sole 3 is located below the upper 2. The sole 3 covers the sole of a wearer. The sole 3 includes an outsole 30 and a midsole 31. The sole 3 is fixed to the upper main body 20 by sewing, welding, bonding, or a combination thereof. A lower surface of the outsole 30 serves as a ground contact surface 30*a* to be in contact with the ground. The midsole 31 is located on an upper surface of the outsole 30, and has a cushioning property. Alternatively, the outsole 30 may be integrated with the midsole 31. The outsole 30 integrated with the midsole 31 is also referred to as a "unisole".

Figure 3:
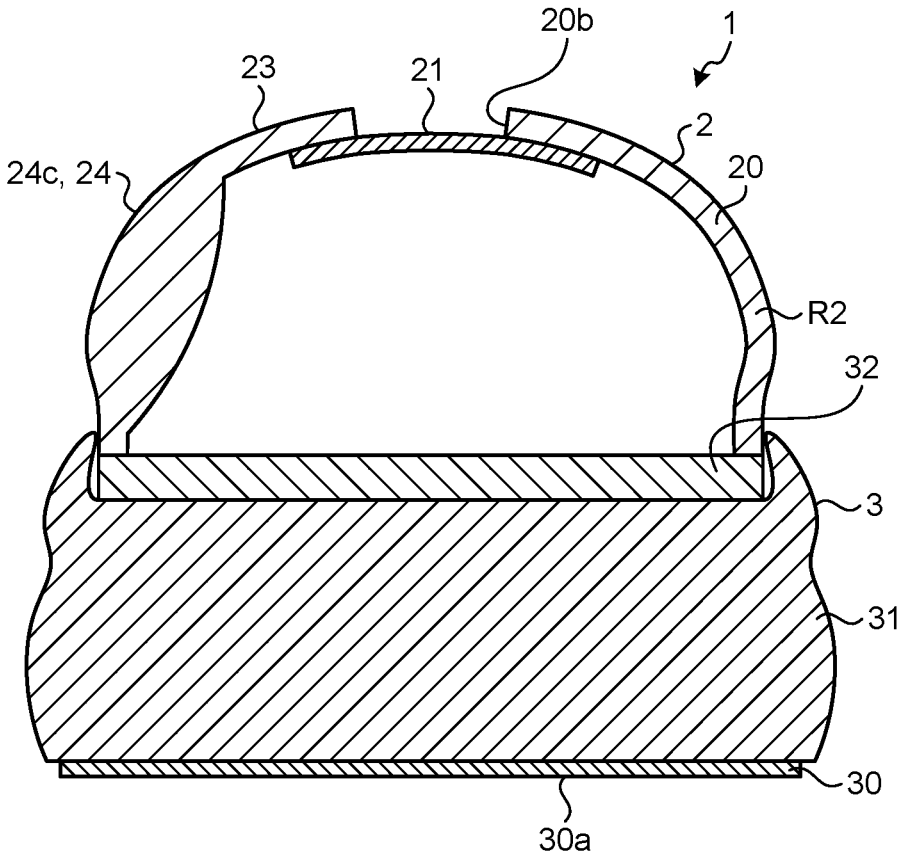
FIG. 3 is a cross-sectional view taken along line III-III illustrated in FIG. 2.
Figure 4:
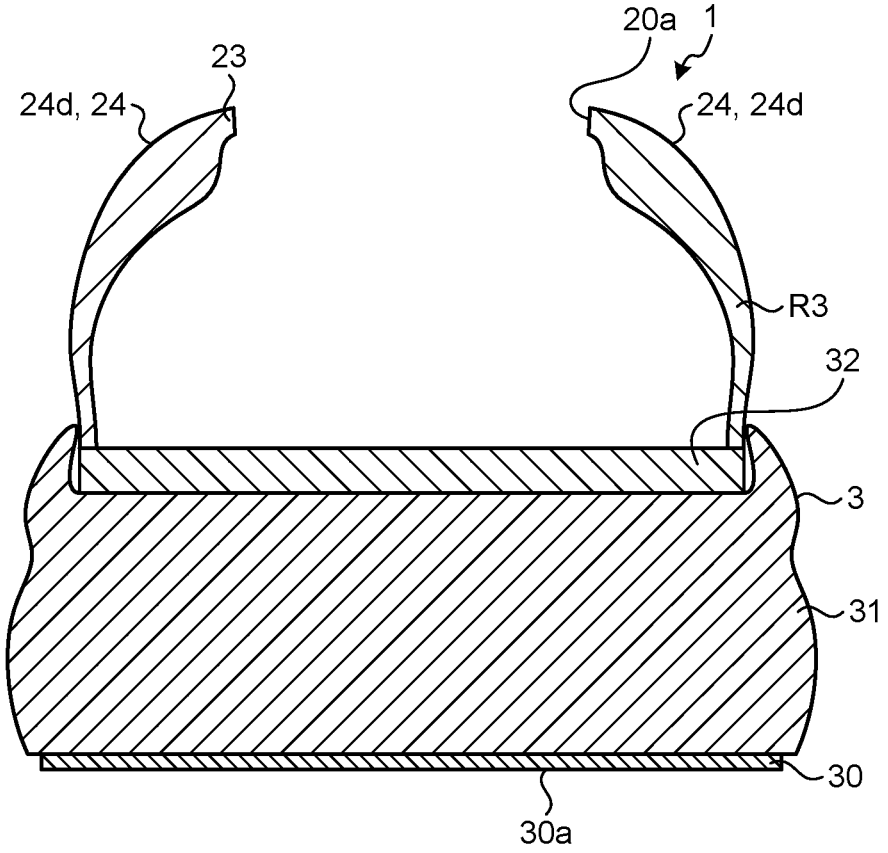
FIG. 4 is a cross-sectional view taken along line IV-IV illustrated in FIG. 2.

FIG. 3 is a cross-sectional view taken along line III-III illustrated in FIG. 2. FIG. 4 is a cross-sectional view taken along line IV-IV illustrated in FIG. 2. In FIGS. 3 and 4, for easy understanding, the first portion 23 and the second portion 24 are hatched with oblique lines, and the first portion 23 and the second portion 24 are illustrated in a simplified manner. As illustrated in FIGS. 3 and 4, a sole 3 includes an insole 32 that covers a lower opening of the upper main body 20. The insole 32 is fixed to a lower edge of the upper main body 20 by sewing. Further, the insole 32 is fixed to an upper surface of a midsole 31 by bonding or welding. Although not illustrated, the shoe 1 may include a footbed. When the shoe 1 includes a footbed, the footbed is placed on the sole 3 inside the upper 2. Alternatively, the sole 3 may have a structure in which the insole 32 is omitted.

Figure 5:
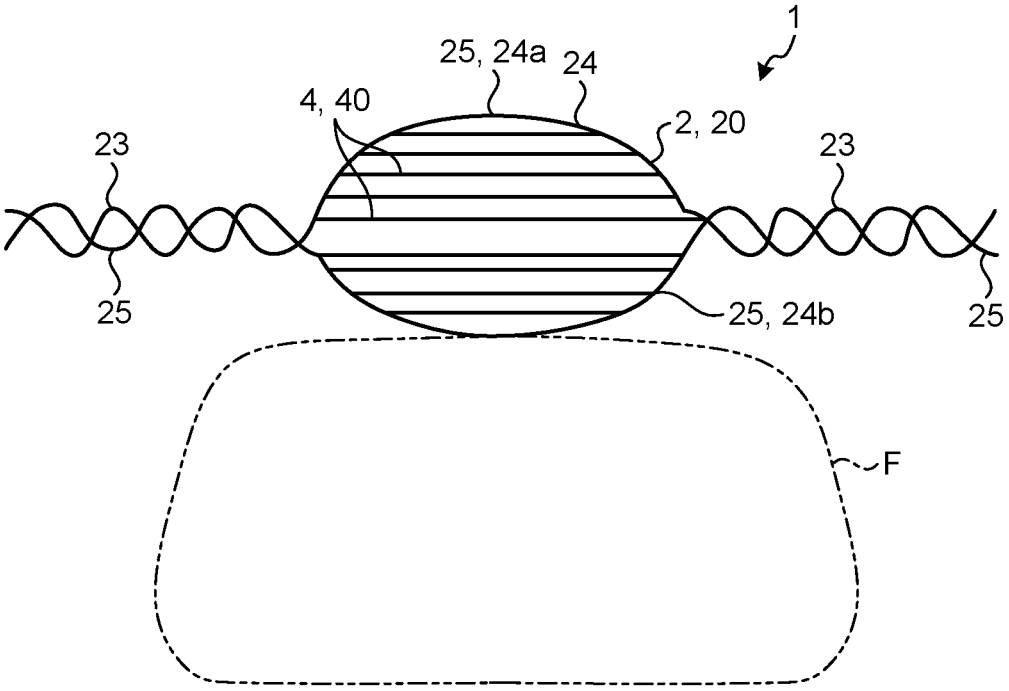
FIG. 5 is a cross-sectional view taken along line V-V illustrated in FIG. 1.

Next, with reference to FIGS. 1, 3, 4, and 5, configurations of the first portion 23 and the second portion 24 of the upper main body 20 will be described in detail. FIG. 5 is a cross-sectional view taken along line V-V illustrated in FIG. 1. In FIG. 5, a foot F of a wearer is schematically illustrated for easy understanding, and a ratio between the foot F and the first portion 23 and the second portion 24 is different from an actual ratio. As illustrated in FIG. 5, the upper main body 20 includes: the first portion 23 including a plurality of linear bodies 25 and formed by one layer; and the bag-shaped second portion 24 formed by two layers in which some of the plurality of linear bodies 25 constituting the first portion 23 serve as one layer and the rest of the plurality of linear bodies 25 serves as another layer. The linear body 25 is, for example, a yarn obtained by bundling a plurality of fibers, a linear resin, or the like.

In the following description, a side facing a direction outward of the upper main body 20 in the first portion 23 and the second portion 24, that is, a side facing away from the foot F of the wearer is referred to as a "front side", and a side facing a direction inward of the upper main body 20 in the first portion 23 and the second portion 24, that is, a side facing the foot F of the wearer is referred to as a "back side". In the following description, a direction parallel to a direction from one of the front side and the back side toward another is referred to as a "front-back direction". In the following description, one layer of the second portion 24 is referred to as a "front layer 24*a*", and another layer of the second portion 24 is referred to as a "back layer 24*b*".

The first portion 23 is a portion thinner than the second portion 24. In the first portion 23, the plurality of linear bodies 25 are entangled in one layer. That is, the linear bodies 25 divided into two layers of the front layer 24*a* and the back layer 24*b* in the second portion 24 are entangled so as to form one layer in the first portion 23. In the present specification, meaning of "the linear bodies 25 are entangled" includes that the linear bodies 25 are interknitted, the linear bodies 25 are interwoven, the linear bodies 25 are braided, and the like.

The second portion 24 is a convex portion protruding toward the foot F of the wearer with respect to the first portion 23. In the present embodiment, the second portion 24 also protrudes toward a side opposite to the foot F of the wearer with respect to the first portion 23. In the second portion 24, the plurality of linear bodies 25 are entangled so as to form two layers of the front layer 24*a* and the back layer 24*b*. The front layer 24*a* and the back layer 24*b* are separated from each other in the front-back direction. The front layer 24*a* is formed in an arc shape protruding to the front side with respect to the first portion 23. The back layer 24*b* is formed in an arc shape protruding to the back side with respect to the first portion 23.

Inside the second portion 24, a cushioning material 4 is put. In the present embodiment, the cushioning material 4 is a plurality of linear bodies 40 formed separately from the linear bodies 25. The linear body 40 is, for example, a yarn obtained by bundling a plurality of fibers, a linear resin, or the like. Each of the plurality of linear bodies 40 is arranged in a state of not being entangled with the linear body 25, and extends linearly in a direction orthogonal to the front-back direction. The plurality of linear bodies 40 are arranged in parallel to each other. In the present embodiment, the entire linear body 40 is accommodated in the second portion 24, but a part of the linear body 40 may be exposed outside the second portion 24 and entangled with the linear body 25 in the first portion 23. Note that the linear bodies 40 are put into the second portion 24 in a process of entangling the linear body 25 to form the first portion 23 and the second portion 24.

As illustrated in FIG. 1, it suffices that the second portion 24 is provided in at least one of an upper midfoot portion R2 or an upper rearfoot portion R3, but the second portion 24 is formed in the upper midfoot portion R2 and the upper rearfoot portion R3 in the present embodiment. The second portion 24 includes a side portion 24*c* provided in a medial foot side region in the upper midfoot portion R2 and an under-malleolus portion 24*d* provided in a region corresponding to a portion below a malleolus of the wearer in the upper rearfoot portion R3.

The number of the side portions 24*c* is not particularly limited, but one side portion 24*c* is provided on the medial foot side of the throat portion 20*b*, in the present embodiment. The side portion 24*c* extends in the fore-rear direction of the upper main body 20 in the upper midfoot portion R2. A shape of the side portion 24*c* is not particularly limited, but is a rectangular shape with rounded corners in the present embodiment.

The number of the under-malleolus portion 24*d* is not particularly limited, but two under-malleolus portions 24*d* in total are provided in the present embodiment, one on each of both sides in the foot width direction across a foot insertion opening 20*a*. The under-malleolus portion 24*d* extends along an edge of the foot insertion opening 20*a* in the upper rearfoot portion R3. The under-malleolus portion 24*d* is located around the foot insertion opening 20*a*. A shape of the under-malleolus portion 24*d* is not particularly limited, but is a rectangular shape with rounded corners in the present embodiment.

The upper main body 20 has two sewn edges 26 that are sewn when the upper main body 20 is assembled. A position of the sewn edge 26 in a state where the upper main body 20 is assembled is a terminal edge on the heel side of the upper main body 20 in the present embodiment.

Next, effects of the shoe 1 according to the present embodiment will be described.

In the present embodiment, as illustrated in FIG. 5, the upper main body 20 includes: the first portion 23 including the plurality of linear bodies 25 and formed by one layer; and the bag-shaped second portion 24 formed by two layers in which some of the plurality of linear bodies 25 constituting the first portion 23 serve as one layer and the rest of the plurality of linear bodies 25 serves as another layer. In addition, the linear body 40 which is the cushioning material 4 is put inside the second portion 24, and the second portion 24 protrudes toward the foot F of the wearer with respect to the first portion 23. With these configurations, a gap generated between the upper main body 20 and the foot F can be filled by the second portion 24 and the cushioning material 4, which can disperse a pressure on the foot F when the shoe 1 is worn and can enhance the fitting between the upper main body 20 and the foot F. In addition, in the present embodiment, since the first portion 23 and the second portion 24 are formed by a single material using the linear body 25, the first portion 23 and the second portion 24 can be formed in one work process. Therefore, it is not necessary to attach a lining material to the upper main body 20 by glue, sewing, or the like to form the bag-shaped second portion 24, and the number of manufacturing processes, an amount of waste materials, and the like of the upper main body 20 can be reduced to reduce an environmental load. That is, in the present embodiment, a gap generated between the upper main body 20 and the foot F can be filled while the environmental load is reduced.

In the present embodiment, as illustrated in FIG. 5, the second portion 24 can be formed in one work process without using glue. Therefore, the second portion 24 can be finished softer than a case where the upper main body 20 and the lining material are bonded with glue to form the bag-shaped portion.

In the present embodiment, as illustrated in FIG. 5, since the cushioning material 4 includes the linear body 40, a material of the cushioning material 4 can be made identical to materials of the first portion 23 and the second portion 24. Therefore, the first portion 23, the second portion 24, and the cushioning material 4 can be formed in one work process. This can further reduce the number of manufacturing processes, the amount of waste materials, and the like of the upper main body 20, to reduce the environmental load. In addition, by making the material of the cushioning material 4 identical to the materials of the first portion 23 and the second portion 24, recycling efficiency can also be improved.

In the present embodiment, as illustrated in FIG. 5, since the second portion 24 protrudes toward a side opposite to the foot F of the wearer with respect to the first portion 23, an impact when the shoe 1 comes into contact with a person, an object, or the like can be alleviated.

In the present embodiment, as illustrated in FIG. 1, the upper main body 20 includes an upper forefoot portion R1 that covers a forefoot portion of the foot F of the wearer, the upper midfoot portion R2 that covers a midfoot portion of the foot F of the wearer, and the upper rearfoot portion R3 that covers a rearfoot portion of the foot F of the wearer. Further, the foot insertion opening 20*a* for insertion of the foot is formed in the upper main body 20. Moreover, the second portion 24 is provided in the upper midfoot portion R2 and the upper rearfoot portion R3. These configurations make it possible to fill a gap generated between the foot F and the upper midfoot portion R2 and the upper rearfoot portion R3. In particular, in the present embodiment, since the second portion 24 is provided in the medial foot side region in the upper midfoot portion R2 and a region corresponding to a portion below the malleolus of the wearer in the upper rearfoot portion R3, it is possible to reliably fill a gap that is likely to be generated between with the foot F.

In the present embodiment, as illustrated in FIG. 1, the number of the side portions 24*c* is one on the medial foot side in the foot width direction across the throat portion 20*b* in the present embodiment, but may be plural. Further, in the present embodiment, the side portion 24*c* is provided on the medial foot side alone in the foot width direction across the throat portion 20*b*, but may be provided on the lateral foot side alone in the foot width direction across the throat portion 20*b*.

Second Embodiment

Figure 6:
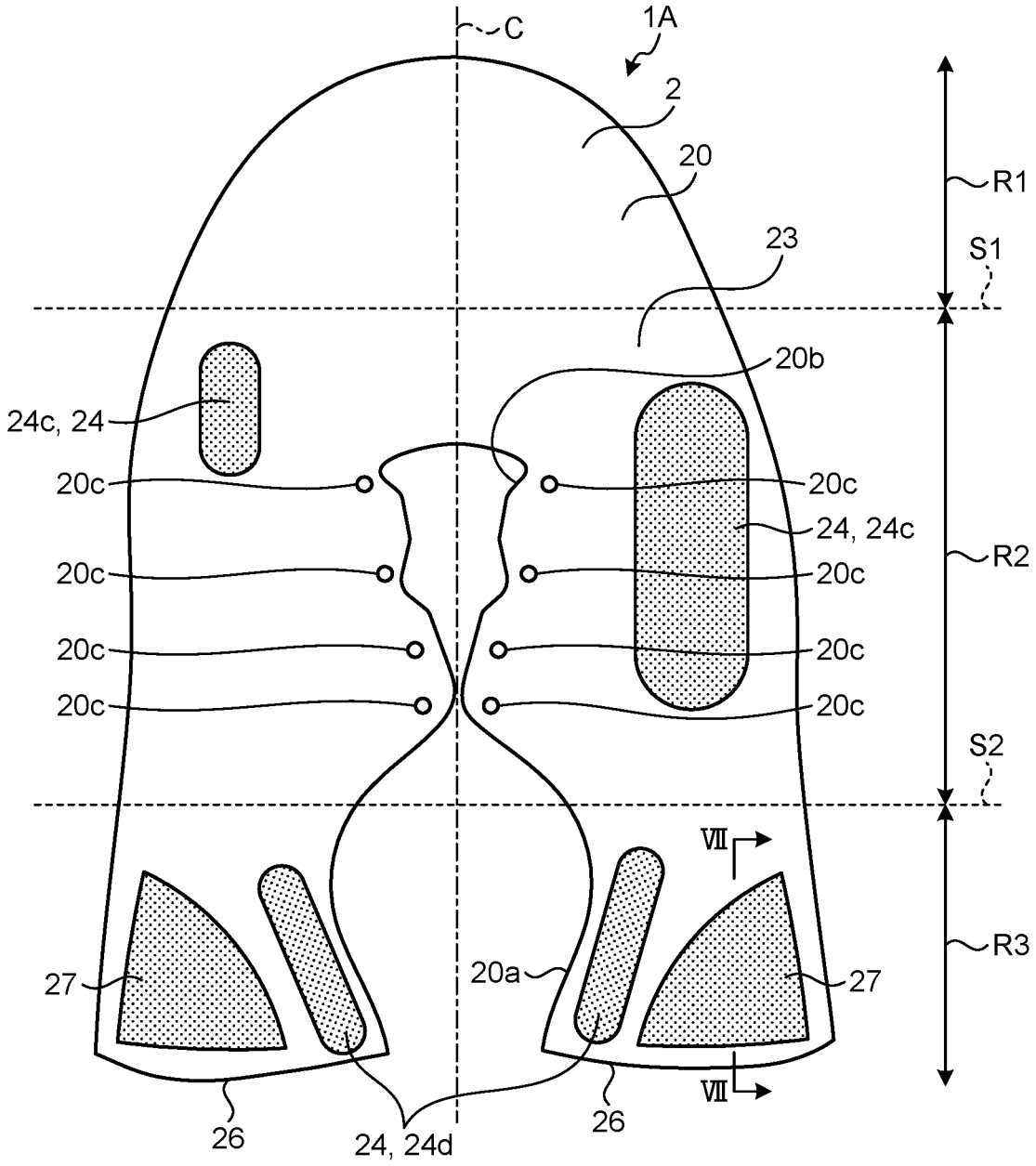
FIG. 6 is a developed view illustrating an upper main body of a shoe according to a second embodiment.
Figure 7:
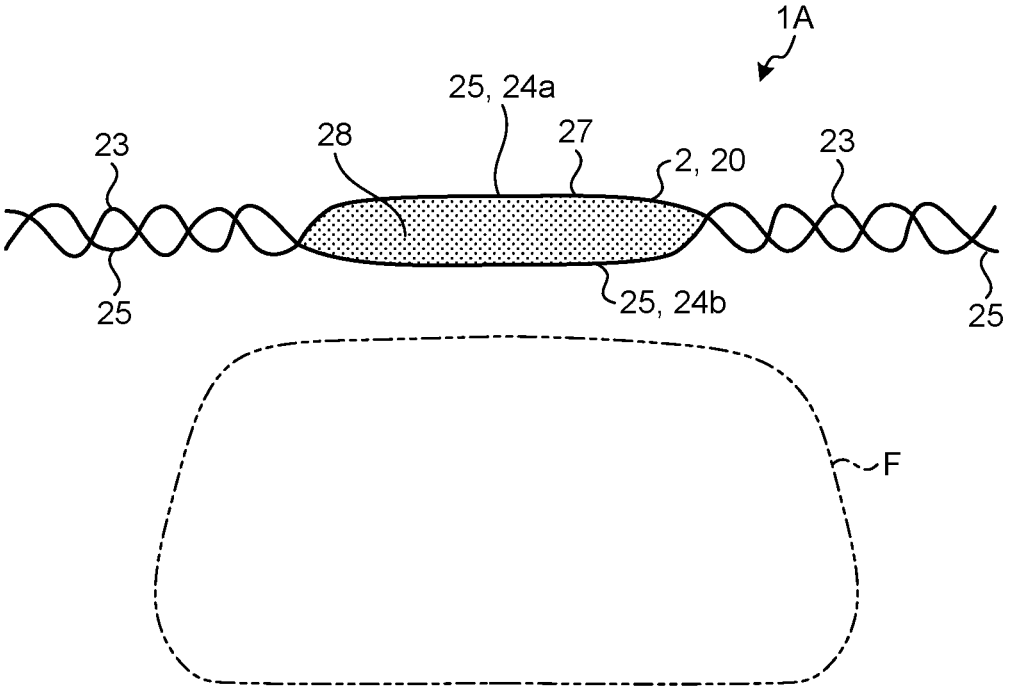
FIG. 7 is a cross-sectional view taken along line VII-VII illustrated in FIG. 6.

FIG. 6 is a developed view illustrating an upper main body 20 of a shoe 1A according to a second embodiment. FIG. 7 is a cross-sectional view taken along line VII-VII illustrated in FIG. 6. The shoe 1A according to the second embodiment is different from the shoe 1 according to the first embodiment in that a side portion 24*c* is also provided on the lateral foot side in the foot width direction across a throat portion 20*b*, and that a third portion 27 is included.

As illustrated in FIG. 6, a second portion 24 is formed in an upper midfoot portion R2 and an upper rearfoot portion R3 in the present embodiment. The second portion 24 includes: a side portion 24*c* provided in the medial foot side region in the upper midfoot portion R2; a side portion 24*c* provided in a lateral foot side region in the upper midfoot portion R2; and an under-malleolus portion 24*d* provided in a region corresponding to a portion below a malleolus of the wearer in the upper rearfoot portion R3.

In the present embodiment, the side portions 24*c* is provided on each of both sides in the foot width direction across the throat portion 20*b*. The number of the side portions 24*c* is not particularly limited, but two side portions 24*c* are provided in total, one on each of the medial foot side and the lateral foot side of the throat portion 20*b* in the present embodiment. The side portion 24*c* extends in the fore-rear direction of the upper main body 20 in the upper midfoot portion R2. A shape of the side portion 24*c* is not particularly limited, but is a rectangular shape with rounded corners in the present embodiment. An area of the side portion 24*c* on the lateral foot side is smaller than an area of the side portion 24*c* on the medial foot side. A center of the side portion 24*c* on the lateral foot side in the fore-rear direction is located forward from a center of the side portion 24*c* on the medial foot side in the fore-rear direction and a center of the throat portion 20*b* in the fore-rear direction.

As illustrated in FIG. 7, the upper main body 20 includes the bag-shaped third portion 27 formed by two layers in which some of a plurality of linear bodies 25 constituting a first portion 23 serve as one layer and the rest of the plurality of linear bodies 25 serves as another layer. Inside the third portion 27, a shape retaining material 28 is put. The shape retaining material 28 is a resin member or a solidified linear body. The linear body is, for example, a yarn that is melted by heat and solidified. The shape retaining material 28 is in close contact with a front layer 24*a* and a back layer 24*b*, and is filled throughout the inside of the third portion 27. A thickness of the third portion 27 is identical to or substantially identical to a thickness of the first portion 23.

As illustrated in FIG. 6, the third portion 27 is provided in a region corresponding to a heel portion of the wearer in the upper rearfoot portion R3. In the present embodiment, two third portions 27 are provided in total, one on each of both sides in the foot width direction across the foot insertion opening 20*a*. The third portion 27 is arranged below the under-malleolus portion 24*d* and spaced apart from the under-malleolus portion 24*d*. The third portion 27 is located between the under-malleolus portion 24*d* and the sole 3. A shape of the third portion 27 is not particularly limited, but is substantially triangular in the present embodiment.

The present embodiment can achieve effects similar to those of the first embodiment described above. Further, in the present embodiment, as illustrated in FIG. 6, the second portion 24 can reliably fill a gap that is likely to be generated between with a foot F, by being provided in the medial foot side region in the upper midfoot portion R2, the lateral foot side region in the upper midfoot portion R2, and the region corresponding to the portion below the malleolus of the wearer in the upper rearfoot portion R3.

In the present embodiment, as illustrated in FIG. 7, the upper main body 20 includes the bag-shaped third portion 27 formed by two layers in which some of the plurality of linear bodies 25 constituting the first portion 23 serve as one layer and the rest of the plurality of linear bodies 25 serves as another layer. Further, the third portion 27 is provided in a region corresponding to the heel portion of the wearer in the upper rearfoot portion R3, and the shape retaining material 28 is put inside the third portion 27. With these configurations, a housing portion of the shape retaining material 28 can be formed by the same material as the first portion 23. In addition, a plastic heel counter that has been conventionally used can be substituted with a solidified linear body.

Note that the second portion 24 may be provided instead of the third portion 27 illustrated in FIG. 6. That is, the second portion 24 may be provided in the region corresponding to the heel portion of the wearer in the upper rearfoot portion R3.

Third Embodiment

Figure 8:
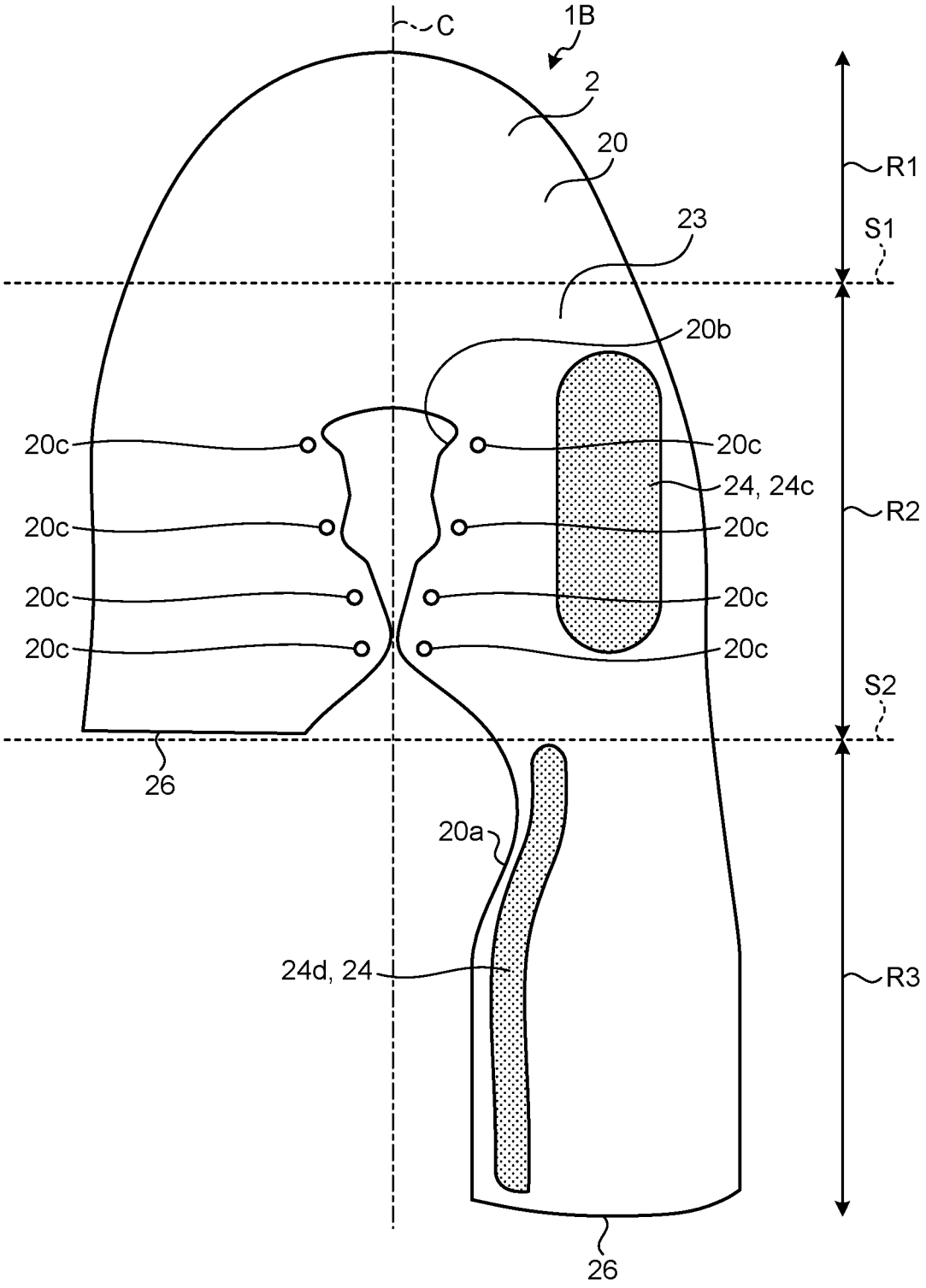
FIG. 8 is a developed view illustrating an upper main body of a shoe according to a third embodiment.

FIG. 8 is a developed view illustrating an upper main body 20 of a shoe 1B according to a third embodiment. The shoe 1B according to the third embodiment is different from the shoe 1 according to the first embodiment in a position of a sewn edge 26.

When the upper main body 20 in a developed state illustrated in FIG. 8 is assembled, the position of the sewn edge 26 is on a side of a throat portion 20*b*. That is, the position of the sewn edge 26 in a state where the upper main body 20 is assembled is the terminal edge on the heel side of the upper main body 20 in the first embodiment, but is on the side of the throat portion 20*b* in the present embodiment. The position of the sewn edge 26 in the state where the upper main body 20 is assembled is on a lateral foot side of the throat portion 20*b* in the present embodiment, but may be on a medial foot side. The medial foot side portion of the upper main body 20 extends rearward with respect to the lateral foot side portion of the upper main body 20. An under-malleolus portion 24*d* is formed in one piece. The under-malleolus portion 24*d* extends along an edge of the foot insertion opening 20*a* in the upper rearfoot portion R3. In a state where the upper main body 20 illustrated in FIG. 8 is assembled, the under-malleolus portion 24*d* is continuously formed without a gap from the medial foot side to the lateral foot side through the terminal edge on the heel side in the upper rearfoot portion R3. The under-malleolus portion 24*d* extends so as to surround the foot insertion opening 20*a*.

The present embodiment can achieve effects similar to those of the first embodiment described above. Further, in the present embodiment, since the position of the sewn edge 26 in the state where the upper main body 20 is assembled is on the side of the throat portion 20*b*, the under-malleolus portion 24*d* can be continuously formed without a gap from the medial foot side to the lateral foot side through the terminal edge on the heel side in the upper rearfoot portion R3. Therefore, a pressure on a heel portion of a foot F when the shoe 1B is worn can be dispersed, and the fitting between the upper main body 20 and the heel portion of the foot F can be enhanced.

Fourth Embodiment

Figure 9:
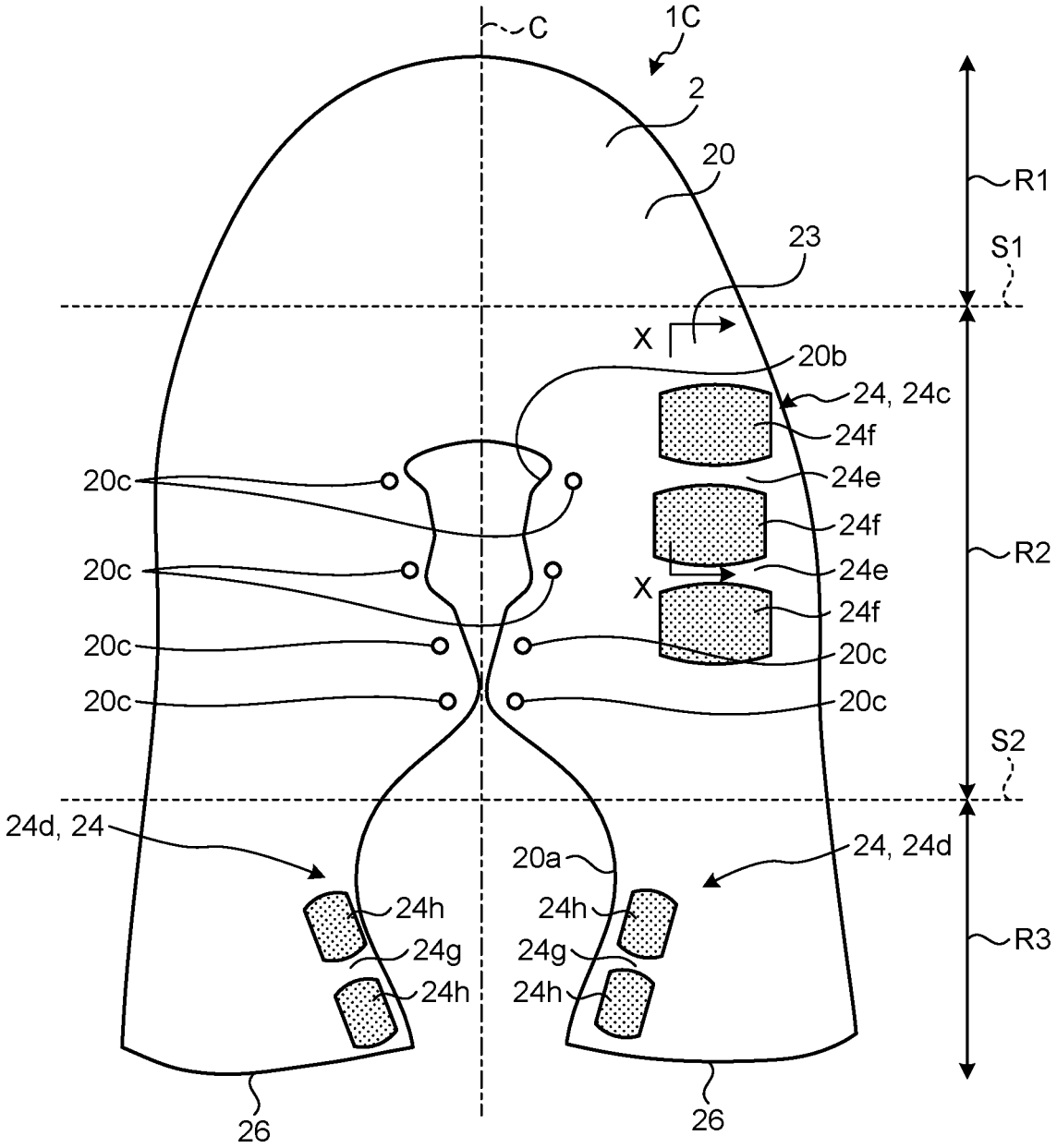
FIG. 9 is a developed view illustrating an upper main body of a shoe according to a fourth embodiment.

FIG. 9 is a developed view illustrating an upper main body 20 of a shoe 1C according to a fourth embodiment. The shoe 1C according to the fourth embodiment is different from the shoe 1 according to the first embodiment in that a second portion 24 is divided.

As illustrated in FIG. 9, the second portion 24 includes a side portion 24*c* provided in a medial foot side region in the upper midfoot portion R2 and an under-malleolus portion 24*d* provided in a region corresponding to a portion below a malleolus of a wearer in an upper rearfoot portion R3. The side portion 24*c* is divided into a plurality of sections 24*f* by a partition 24*e*. The side portion 24*c* is divided into a plurality of pieces in the fore-rear direction in the present embodiment. The number of the sections 24*f* of the side portion 24*c* is not particularly limited, but is three in the present embodiment.

The under-malleolus portion 24*d* is provided on each of both sides in the foot width direction across a foot insertion opening 20*a*. Each under-malleolus portion 24*d* is divided into a plurality of sections 24*h* by a partition 24*g*. In the present embodiment, the under-malleolus portion 24*d* is divided into a plurality of pieces in the fore-rear direction. The number of the sections 24*h* of the under-malleolus portion 24*d* is not particularly limited, but is two in the present embodiment. Note that the second portion 24 may be divided into a plurality of pieces in the foot width direction, or may be divided into a plurality of pieces in the fore-rear direction and the foot width direction.

Figure 10:
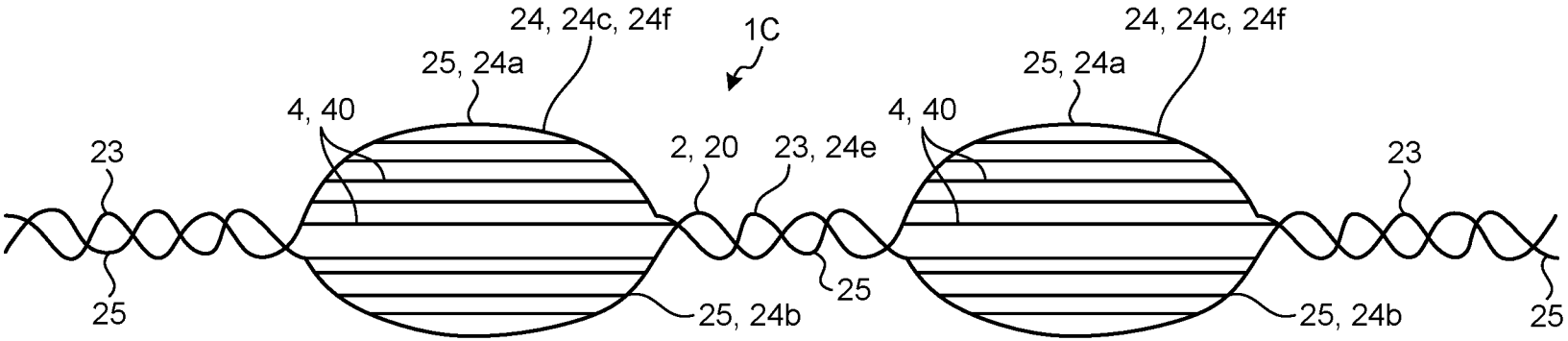
FIG. 10 is a cross-sectional view taken along line X-X illustrated in FIG. 9.

FIG. 10 is a cross-sectional view taken along line X-X illustrated in FIG. 9. The partition 24*e* is a first portion 23 in the present embodiment. The first portion 23 is arranged between the adjacent sections 24*f*. That is, the adjacent sections 24*f* are arranged at intervals with the first portion 23 interposed in between. The partition 24*g* has a configuration similar to the partition 24*e*.

Figure 11:
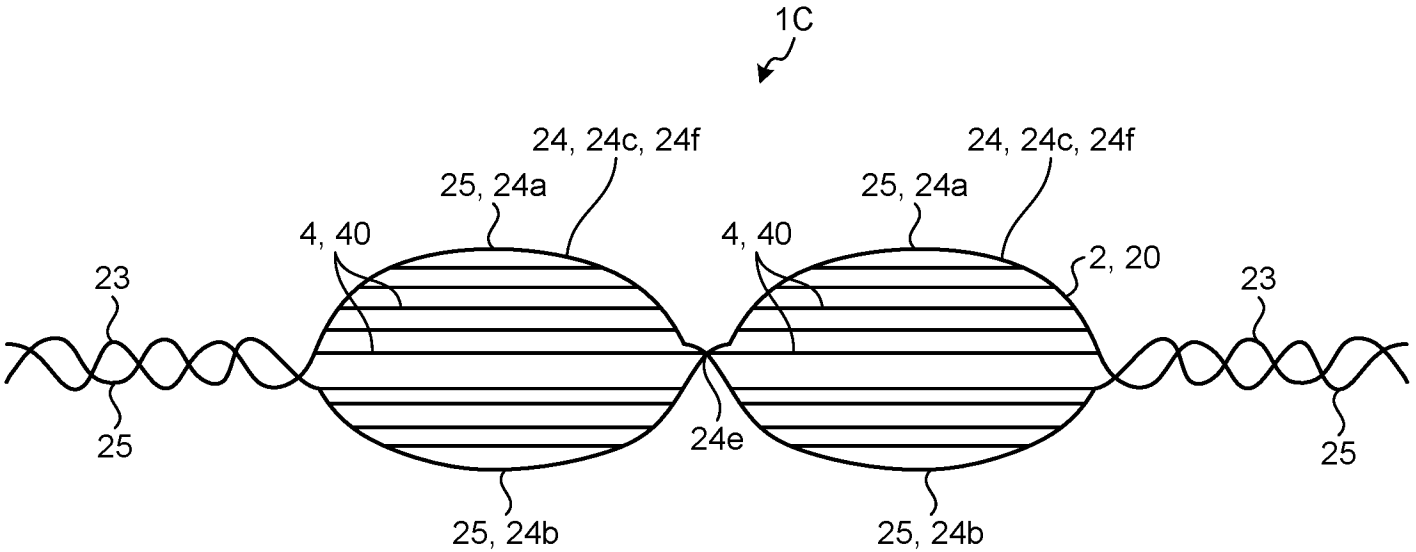
FIG. 11 is a cross-sectional view illustrating an upper main body of a shoe according to a modification of the fourth embodiment, and is a view corresponding to a cross-sectional view taken along line X-X illustrated in FIG. 9.

FIG. 11 is a cross-sectional view illustrating an upper main body 20 of a shoe 1C according to a modification of the fourth embodiment, and is a view corresponding to a cross-sectional view taken along line X-X illustrated in FIG. 9. As illustrated in FIG. 11, the partition 24*e* may be, for example, a portion that causes a front layer 24*a* and a back layer 24*b* to cross each other to close, a portion that couples the front layer 24*a* and the back layer 24*b* to each other, or the like. The adjacent sections 24*f* are arranged adjacent to each other with no space in between.

The present embodiment can achieve effects similar to those of the first embodiment described above. Further, in the present embodiment, by dividing each of the second portions 24 into the plurality of sections 24*f* and 24*h* by the partitions 24*e* and 24*g*, a gap is formed between each of the partitions 24*e* and 24*g* and a foot F, so that air permeability inside the upper main body 20 can be improved. Moreover, in the present embodiment, by dividing each of the second portions 24 into the plurality of sections 24*f* and 24*h* by the partitions 24*e* and 24*g*, a cushioning material 4 can be put in each of the sections 24*f* and 24*h*, so that an amount of the cushioning material 4 can be changed for each of the sections 24*f* and 24*h*. This allows each of the second portions 24 to be partially thickened or thinned.

Fifth Embodiment

Figure 12:
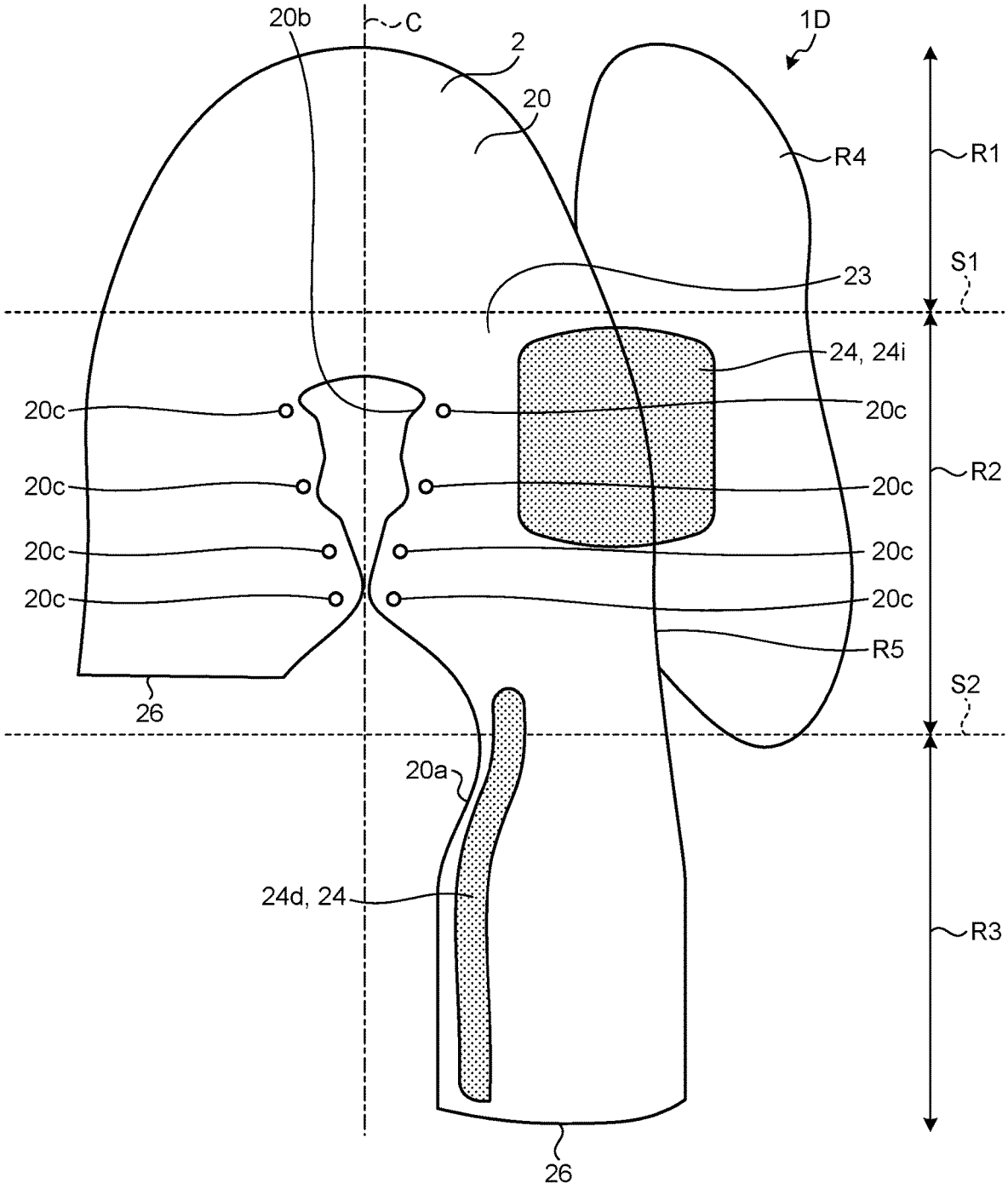
FIG. 12 is a developed view illustrating an upper main body of a shoe according to a fifth embodiment.

FIG. 12 is a developed view illustrating an upper main body 20 of a shoe 1D according to a fifth embodiment. The shoe 1D according to the fifth embodiment is different from the shoe 1 according to the first embodiment in a position of a sewn edge 26 and in that the upper main body 20 includes an upper sole portion R4.

As illustrated in FIG. 12, the position of the sewn edge 26 is similar to that of the third embodiment described above. The upper main body 20 includes the upper sole portion R4 that is formed continuously with an upper midfoot portion R2 and covers a sole of a wearer having a standard body shape. The upper sole portion R4 is connected to a lower edge on the medial foot side of the upper midfoot portion R2. The upper sole portion R4 serves as an insole that covers a lower opening formed by being surrounded by a lower edge of an upper forefoot portion R1, a lower edge of the upper midfoot portion R2, and a lower edge of an upper rearfoot portion R3. When the upper main body 20 includes the upper sole portion R4, the insole 32 of the sole 3 illustrated in FIGS. 3 and 4 may be omitted. The upper sole portion R4 is fixed to an upper surface of the midsole 31 illustrated in FIGS. 3 and 4 by bonding or welding. When the shoe 1 includes a footbed, the footbed is placed on the upper sole portion R4 inside the upper main body 20.

A second portion 24 includes a side sole portion 24*i* provided across the upper midfoot portion R2 and the upper sole portion R4. The side sole portion 24*i* is provided continuously from the upper midfoot portion R2 to the upper sole portion R4. A part of the side sole portion 24*i* extends in the up-down direction and the fore-rear direction in the upper midfoot portion R2. The rest of the side sole portion 24*i* extends in the foot width direction and the fore-rear direction in the upper sole portion R4. A portion of the side sole portion 24*i* located in the upper sole portion R4 is provided at a position corresponding to an arch of the foot of the wearer in the up-down direction.

The present embodiment can achieve effects similar to those of the first embodiment described above. In addition, in the present embodiment, the upper main body 20 includes the upper sole portion R4 that is formed continuously with the upper midfoot portion R2 and covers the sole of the foot of the wearer, and the second portion 24 is provided across the upper midfoot portion R2 and the upper sole portion R4. Therefore, the convex second portion 24 can also be formed at a position corresponding to the arch of the foot of the wearer in the up-down direction. Therefore, the fitting between the upper main body 20 and the arch of a foot F can be enhanced.

Moreover, the second portion 24 is formed in one piece in the present embodiment, but may be divided into a plurality of pieces in the fore-rear direction or the foot width direction, or may be divided into a plurality of pieces in the fore-rear direction and the foot width direction. When the side sole portion 24*i* is divided, the partition 24*e* illustrated in FIG. 10 or 11 is preferably located along a boundary portion R5 between the upper midfoot portion R2 and the upper sole portion R4. That is, the side sole portion 24*i* may be intermittently provided from the upper midfoot portion R2 to the upper sole portion R4.

When the upper midfoot portion R2 and the upper sole portion R4 are continuously formed as illustrated in FIG. 12, a pressure is likely to be applied to the boundary portion R5 between the upper midfoot portion R2 and the upper sole portion R4 when the sole 3 illustrated in FIG. 2 is attached to the upper main body 20. Therefore, when the second portion 24 thicker than a first portion 23 is located at the boundary portion R5, the boundary portion R5 may not be folded neatly. Therefore, by positioning the partition 24*e* illustrated in FIG. 10 or 11 along the boundary portion R5 between the upper midfoot portion R2 and the upper sole portion R4, a thickness of the boundary portion R5 can be reduced, so that the boundary portion R5 can be folded neatly.

Sixth Embodiment

Figure 13:
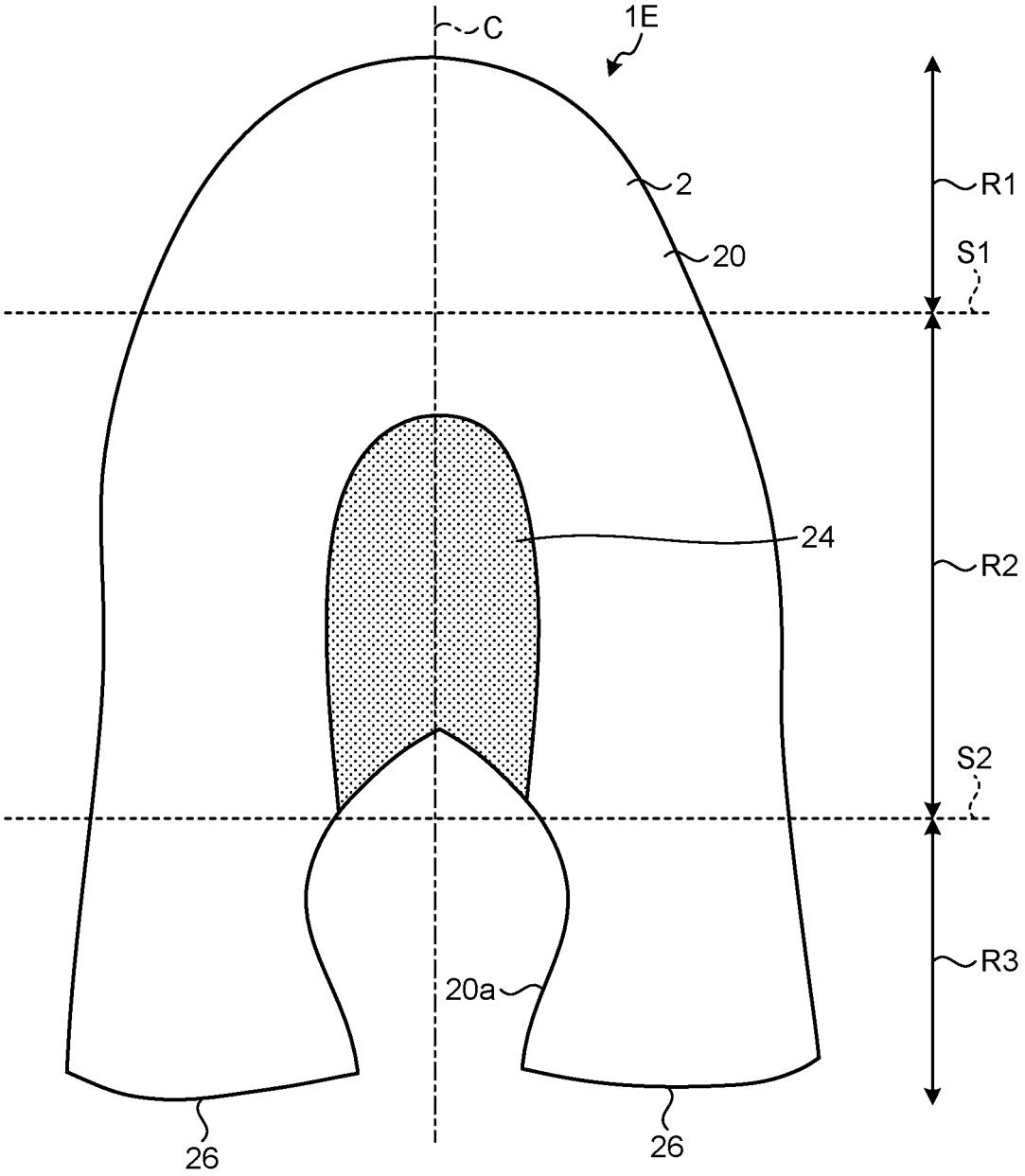
FIG. 13 is a developed view illustrating an upper main body of a shoe according to a sixth embodiment.

FIG. 13 is a developed view illustrating an upper main body 20 of a shoe 1E according to a sixth embodiment. The shoe 1E according to the sixth embodiment is different from the shoe 1 according to the first embodiment in a position of a second portion 24 and in that an upper 2 has a monosock structure.

As illustrated in FIG. 13, the upper 2 has a monosock structure in which a portion corresponding to the shoe tongue 21 of the first embodiment is integrated with an ankle portion of the upper main body 20. The second portion 24 is formed in an upper midfoot portion R2 in the present embodiment. The second portion 24 is provided in a region adjacent to a foot insertion opening 20*a* in front of the foot insertion opening 20*a*. The second portion 24 is provided in a portion corresponding to the shoe tongue 21 of the first embodiment.

The present embodiment can achieve effects similar to those of the first embodiment described above. Furthermore, in the present embodiment, since the second portion 24 is provided in the region adjacent to the foot insertion opening 20*a* in front of the foot insertion opening 20*a*, the second portion 24 is to be a portion corresponding to the shoe tongue 21, so that a pressure on an instep of a foot F can be reduced. Moreover, the second portion 24 is formed in one piece in the present embodiment, but may be divided into a plurality of pieces in the fore-rear direction or the foot width direction, or may be divided into a plurality of pieces in the fore-rear direction and the foot width direction. In addition, the second portion 24 is formed to be laterally symmetrical in the present embodiment, but may be formed to be laterally asymmetrical.

Seventh Embodiment

Figure 14:
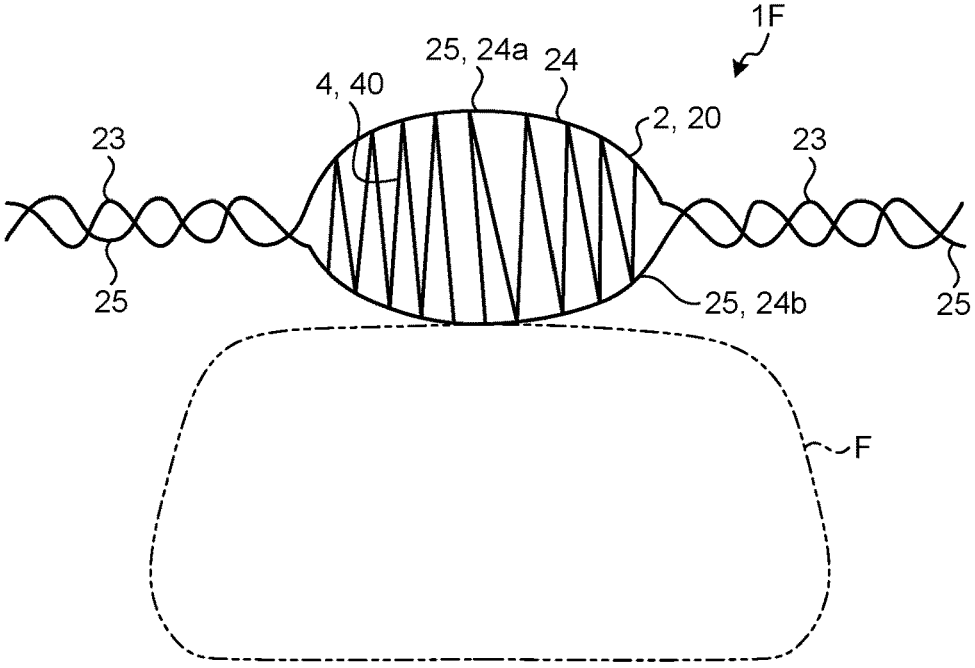
FIG. 14 is a cross-sectional view illustrating an upper main body of a shoe according to a seventh embodiment, and is a view corresponding to a cross-sectional view taken along line V-V illustrated in FIG. 1.

FIG. 14 is a cross-sectional view illustrating an upper main body 20 of a shoe 1F according to a seventh embodiment, and is a view corresponding to a cross-sectional view taken along line V-V illustrated in FIG. 1. The shoe 1F according to the seventh embodiment is different from the shoe 1 according to the first embodiment in a configuration of a cushioning material 4.

As illustrated in FIG. 14, in the present embodiment, the cushioning material 4 is a plurality of linear bodies 40 formed separately from a linear body 25. Although one linear body 40 is illustrated in FIG. 14, the plurality of linear bodies 40 actually exist in a depth direction of in the page. The linear body 40 is, for example, a yarn obtained by bundling a plurality of fibers, a linear resin, or the like. Each of the plurality of linear bodies 40 is entangled with the linear body 25 and connects a front layer 24*a* and a back layer 24*b*. Each linear body 40 is alternately and repeatedly connected to the front layer 24*a* and the back layer 24*b*, and extends in a zigzag shape between the front layer 24*a* and the back layer 24*b*. In the present embodiment, the entire linear body 40 is accommodated in the second portion 24, but a part of the linear body 40 may be exposed outside the second portion 24 and entangled with the linear body 25 in the first portion 23. Note that the linear bodies 40 are put into the second portion 24 in a process of entangling the linear body 25 to form the first portion 23 and the second portion 24.

The present embodiment can achieve effects similar to those of the first embodiment described above. In the present embodiment, the linear body 40 serving as the cushioning material 4 connects the front layer 24*a* and the back layer 24*b* of the second portion 24, so that a force for maintaining a distance between the front layer 24*a* and the back layer 24*b* is increased. Therefore, excessive expansion of the second portion 24 can be suppressed, the second portion 24 is less likely to be crushed when the wearer wears the shoe 1F, and the fitting between the upper main body 20 and a foot F can be enhanced.

Eighth Embodiment

Figure 15:
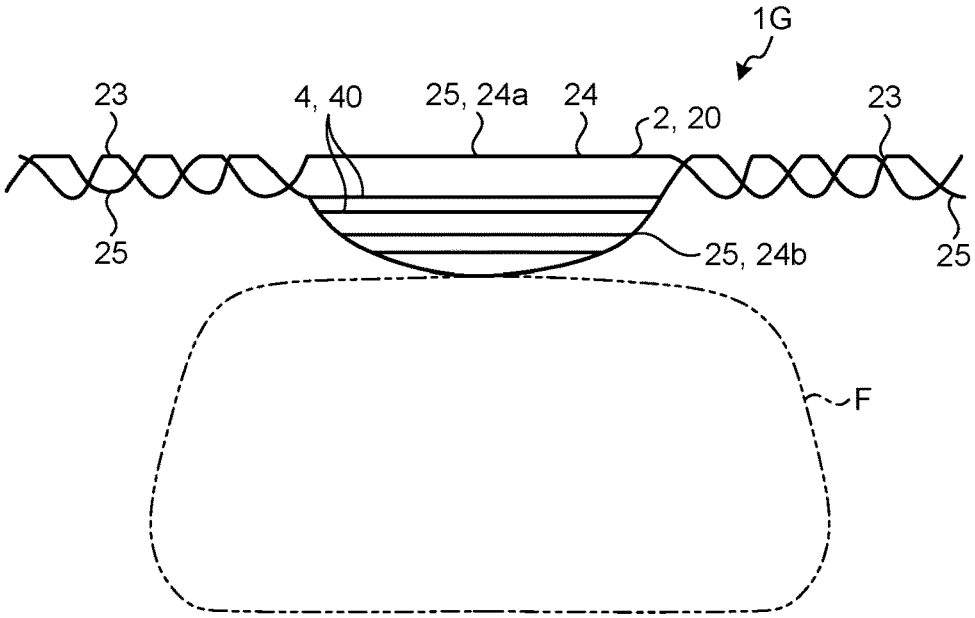
FIG. 15 is a cross-sectional view illustrating an upper main body of a shoe according to an eighth embodiment, and is a view corresponding to a cross-sectional view taken along line V-V illustrated in FIG. 1.

FIG. 15 is a cross-sectional view illustrating an upper main body 20 of a shoe 1G according to an eighth embodiment, and is a view corresponding to a cross-sectional view taken along line V-V illustrated in FIG. 1. The shoe 1G according to the eighth embodiment is different from the shoe 1 according to the first embodiment in a configuration of a second portion 24.

As illustrated in FIG. 15, the second portion 24 protrudes toward a foot F of the wearer with respect to a first portion 23, but does not protrude toward a side opposite to the foot F of the wearer with respect to a first portion 23. A front layer 24*a* is formed in a flat shape. The front layer 24*a* and a portion located on the foremost side of the first portion 23 coincide in position in a direction orthogonal to the front-back direction. The front layer 24*a* extends linearly in a direction orthogonal to the front-back direction. The front layer 24*a* and a linear body 40 are arranged in parallel to each other. The back layer 24*b* is formed in an arc shape protruding to the back side with respect to the first portion 23.

The present embodiment can achieve effects similar to those of the first embodiment described above. Furthermore, in the present embodiment, since the second portion 24 exclusively protrudes toward the foot F of the wearer with respect to the first portion 23, unevenness on a surface side of the upper main body 20 can be suppressed, and the aesthetic appearance of the shoe 1G can be enhanced.

Ninth Embodiment

Figure 16:
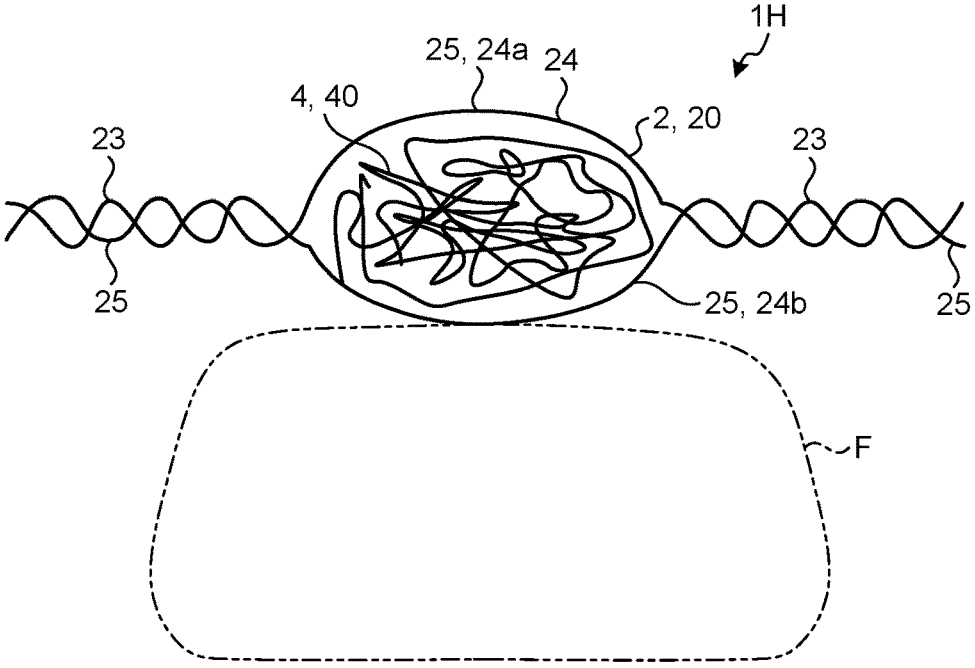
FIG. 16 is a cross-sectional view illustrating an upper main body of a shoe according to a ninth embodiment, and is a view corresponding to a cross-sectional view taken along line V-V illustrated in FIG. 1.

FIG. 16 is a cross-sectional view illustrating an upper main body 20 of a shoe 1H according to a ninth embodiment, and is a view corresponding to a cross-sectional view taken along line V-V illustrated in FIG. 1. The shoe 1H according to the ninth embodiment is different from the shoe 1 according to the first embodiment in a configuration of a cushioning material 4.

As illustrated in FIG. 16, in the present embodiment, the cushioning material 4 is a plurality of linear bodies 40 formed separately from a linear body 25. The linear body 40 is, for example, a yarn obtained by bundling a plurality of fibers, a linear resin, or the like. Each of the plurality of linear bodies 40 is arranged in a state of not being entangled with the linear body 25, and is bent a plurality of times at random. Note that, a first portion 23 and a second portion 24 are formed by entangling the linear bodies 25, and then a hollow needle is inserted from a gap between the linear bodies 25 in the second portion 24 or an opening provided in the second portion 24, to implant the linear body 40 from the needle into the second portion 24. In a case where the opening is provided in the second portion 24, it is preferable to provide the opening in an inconspicuous place such as the back layer 24*b* of the second portion 24.

The present embodiment can achieve effects similar to those of the first embodiment described above. Further, in the present embodiment, since the linear body 40 is put inside the second portion 24 after formation of the second portion 24, an amount of the linear body 40 which is the cushioning material 4 can be finely adjusted.

Tenth Embodiment

Figure 17:
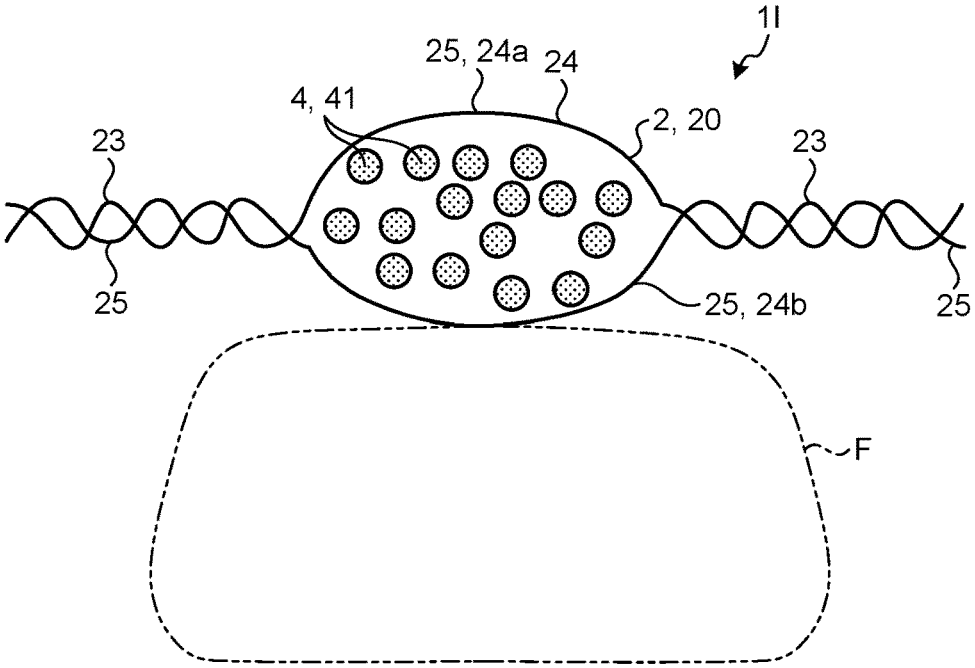
FIG. 17 is a cross-sectional view illustrating an upper main body of a shoe according to a tenth embodiment, and is a view corresponding to a cross-sectional view taken along line V-V illustrated in FIG. 1.

FIG. 17 is a cross-sectional view illustrating an upper main body 20 of a shoe 1I according to a tenth embodiment, and is a view corresponding to a cross-sectional view taken along line V-V illustrated in FIG. 1. The shoe 1I according to the tenth embodiment is different from the shoe 1 according to the first embodiment in a configuration of a cushioning material 4.

As illustrated in FIG. 17, in the present embodiment, the cushioning material 4 is a plurality of beads 41 formed separately from a linear body 25. The beads 41 are, for example, resin beads or the like. Examples of the resin beads include foamed polystyrene beads. A shape of the beads 41 is not particularly limited, but is spherical in the present embodiment. After a first portion 23 and a second portion 24 are formed by entangling the linear bodies 25, the beads 41 are inserted into the second portion 24 through a gap between the linear bodies 25 in the second portion 24 or an opening provided in the second portion 24.

The present embodiment can achieve effects similar to those of the first embodiment described above. In addition, in the present embodiment, since the cushioning material 4 is the beads 41, an impact shock absorbing property, hardness, repulsion, and the like of the cushioning material 4 can be easily adjusted.

Eleventh Embodiment

Figure 18:
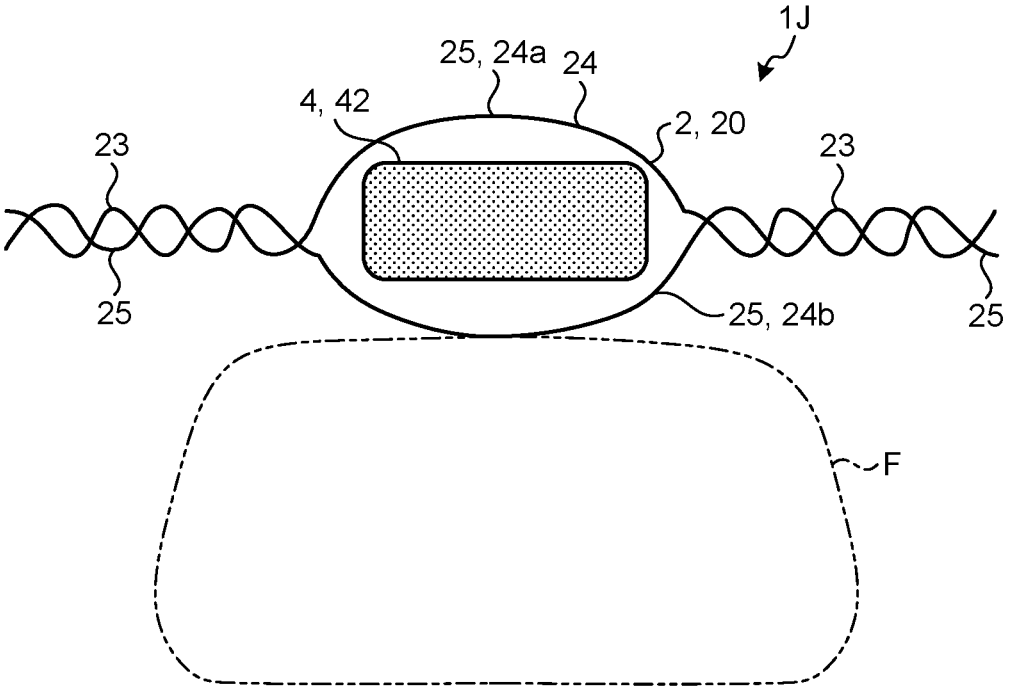
FIG. 18 is a cross-sectional view illustrating an upper main body of a shoe according to an eleventh embodiment, and is a view corresponding to a cross-sectional view taken along line V-V illustrated in FIG. 1.

FIG. 18 is a cross-sectional view illustrating an upper main body 20 of a shoe 1J according to an eleventh embodiment, and is a view corresponding to a cross-sectional view taken along line V-V illustrated in FIG. 1. The shoe 1J according to the eleventh embodiment is different from the shoe 1 according to the first embodiment in a configuration of a cushioning material 4.

As illustrated in FIG. 18, the cushioning material 4 is a foam material 42 formed separately from a linear body 25 in the present embodiment. The foam material 42 is, for example, urethane foam or the like. A shape of the foam material 42 is not particularly limited, but is a rectangular parallelepiped shape in the present embodiment. After a first portion 23 and a second portion 24 are formed by entangling the linear bodies 25, the foam material 42 is inserted into the second portion 24 through a gap between the linear bodies 25 in the second portion 24 or an opening provided in the second portion 24.

The present embodiment can achieve effects similar to those of the first embodiment described above. In addition, in the present embodiment, since the cushioning material 4 is the foam material 42, an impact shock absorbing property, hardness, repulsion, and the like of the cushioning material 4 can be easily adjusted. Note that the cushioning material 4 may simply be made by at least one of a linear body 40, beads 41, or the foam material 42. In other words, two or more of the linear body 40, the beads 41, and the foam material 42 may be combined as the cushioning material 4. In addition, the cushioning material 4 may be a material other than the linear body 40, the beads 41, and the foam material 42 described above, as long as the fitting between the upper main body 20 and a foot F can be improved. As the cushioning material 4, for example, cotton, feathers, or the like may be used. These cushioning materials 4 may be used singly or in combination of two or more kinds thereof.

The upper according to the present invention has an effect of being able to fill a gap generated between the upper and a foot while reducing an environmental load.

The configuration illustrated in the above embodiment illustrates one example of the contents of the present invention and can be combined with another known technique, and it is also possible to omit and change a part of the configuration without departing from the subject matter of the present invention.

What is claimed is:

1. An upper comprising:

an upper main body configured to cover an instep of a foot, wherein the upper main body includes a first portion consisting of a plurality of linear bodies which are interknitted, interwoven, or braided together to form a single layer; and a second portion continuous with the first portion and having a bag shape consisting of two layers, a front layer of the two layers consisting of some of the plurality of linear bodies constituting the single layer of the first portion and a back layer of the two layers consisting of a remainder of the plurality of linear bodies constituting the single layer of the first portion, the linear bodies of the front layer are not interknitted, interwoven, or braided together with the linear bodies of the back layer, such that the linear bodies of the front layer are spaced from the linear bodies of the back layer, a cushioning material is put inside the second portion between the front and back layers, and the second portion protrudes toward a foot of a wearer with respect to the first portion.

2. The upper according to claim 1, wherein the cushioning material includes at least one of a linear body, a bead, or a foam material.

3. The upper according to claim 1, wherein the second portion protrudes toward a side opposite to a foot of a wearer with respect to the first portion.

4. The upper according to claim 1, wherein the upper main body includes an upper forefoot portion configured to cover a forefoot portion of a foot of a wearer, an upper midfoot portion configured to cover a midfoot portion of a foot of a wearer, and an upper rearfoot portion configured to cover a rearfoot portion of a foot of a wearer, a foot insertion opening for insertion of a foot is formed in the upper main body, and the second portion is provided in at least one of the upper midfoot portion or the upper rearfoot portion.

5. The upper according to claim 4, wherein the second portion is provided in at least one of a medial foot side region in the upper midfoot portion, a lateral foot side region in the upper midfoot portion, a region adjacent to the foot insertion opening in front of the foot insertion opening, a region corresponding to a heel portion of a wearer in the upper rearfoot portion, or a region corresponding to a portion below a malleolus of a wearer in the upper rearfoot portion.

6. The upper according to claim 4, wherein the upper main body includes an upper sole portion formed continuously with the upper midfoot portion and configured to cover a sole of a wearer, and the second portion is provided across the upper midfoot portion and the upper sole portion.

7. The upper according to claim 1, wherein the second portion is divided into a plurality of pieces.

8. The upper according to claim 1, wherein the upper main body includes a third portion having a bag shape and formed by two layers in which some of the plurality of linear bodies constituting the first portion serve as one layer and a rest of the plurality of linear bodies serves as another layer, the third portion is provided in a region corresponding to a heel portion of a wearer in the upper main body, and a shape retaining material is put inside the third portion.

9. The upper according to claim 8, wherein the shape retaining material is a resin member or a solidified linear body.

10. A shoe comprising:

the upper according to claim 1; and a sole located below the upper.

* * * * *